United States Patent [19]

Iizuka et al.

[11] 4,120,488

[45] Oct. 17, 1978

[54] STAMPING APPARATUS FOR APPLYING LINING MATERIAL TO IRON RUNNERS

[75] Inventors: Motohiko Iizuka, Fukuyama; Hiroyuki Danjo, Bizen; Kazuo Ikeda, Fukuyama; Masatoshi Yoshimura, Kasaoka, all of Japan

[73] Assignees: Shinagawa Shirorenga Kabushiki Kaisha; Nippon Kokan Kabushiki Kaisha, both of Tokyo; Kabushiki Kaisha Ikeda Kikai Seisakusho; Shinagawa Roko Kabushiki Kaisha, both of Fukuyama, all of Japan

[21] Appl. No.: 871,481

[22] Filed: Jan. 19, 1978

[30] Foreign Application Priority Data

Feb. 4, 1977 [JP] Japan ..... 52-10635

[51] Int. Cl.[2] ..... C21B 7/00

[52] U.S. Cl. ..... 266/281

[58] Field of Search ..... 164/172, 173; 266/196, 266/281, 287; 425/219

[56] References Cited

FOREIGN PATENT DOCUMENTS 250,169 1/1970 U.S.S.R. ..... 266/181

*Primary Examiner*—Gerald A. Dost

*Attorney, Agent, or Firm*—Haseltine, Lake & Waters

[57] ABSTRACT

A stamping apparatus for applying a lining material to an iron runner comprising:

arm means mounted at the base thereof to a travelling device and including a base member vertically mounted to one end thereof, said arm means further including a link mechanism and a swivelling mechanism, whereby said arm means is adapted to vertically and horizontally move said base member;

a balancing cylinder vertically supported on said base member through the intermediary of turning means, said balancing cylinder holding therein a piston by upper and lower cylinder chambers, said balancing cylinder including compressed air inlet means, setting regulator means and main control regulator means for maintaining the pressure in each of said cylinder chambers at a setting pressure and a piston rod whereby maintaining constant the pressing force of at least one rammer mounted to one end of said piston rod, said balancing cylinder being rotatable so as to be held horizontally as well as in an inclined position; and said at least one rammer mounted to said piston rod in parallel with said balancing cylinder.

4 Claims, 4 Drawing Figures

STAMPING APPARATUS FOR APPLYING LINING MATERIAL TO IRON RUNNERS

BACKGROUND OF THE INVENTION

The present invention relates to a stamping apparatus adapted for use in applying a lining material to the iron runner of a blast furnace in ironworks.

In a blast furnace, the inner surface of the iron runner which contacts with molten iron is lined with a refractory material, and the lining is effected for the most part by stamping prepared-unshaped refractories. However, since the application of such lining must be effected at a job site where the atmosphere is fouled by the hot air, dust and the like and since the inner surface of the iron runner is considerably sloped and rugged, the mechanization of the lining operation has made very slow progress and thus it has been the practice to resort to the method of stamping a refractory by manually operation of air rammers which require many hands. On the other hand, stamping apparatus have recently been devised gradually in substitution for the manually operated air rammers. However, it has been difficult for these apparatus to ensure the application of a uniform lining because of their inability to rapidly and smoothly adjust themselves to the ups and downs in the inner surface of the iron runner.

SUMMARY OF THE INVENTION

It is an object of the present invention to provide a stamping apparatus capable of properly adjusting itself to the slopes and irregularities in the inner surface of an iron runner and thereby rapidly and efficiently accomplishing the required stamping operation.

It is another object of the invention to provide a stamping apparatus capable of reducing the number of the personnel required for stamping purposes and providing a finished lining of high quality.

In accordance with the present invention, there is provided a stamping apparatus for applying a lining material to an iron runner comprising:

arm means mounted at the base thereof to a travelling device and including a base member vertically mounted to one end thereof, said arm means further including a link mechanism and a swivelling mechanism, whereby said arm means is adapted to vertically and horizontally move said base member;

a balancing cylinder vertically supported on said base member through the intermediary of turnning means, said balancing cylinder holding therein a piston by upper and lower cylinder chambers, said balancing cylinder including compressed air inlet means, setting regulator means and main control regulator means for maintaining the pressure in each of said cylinder chambers at a setting pressure and a piston rod whereby maintaining constant the pressing force of at least one rammer mounted to one end of said piston rod, said balancing cylinder being rotatable so as to be held horizontally as well as in an inclined position; and said at least one rammer mounted to said piston rod in parallel with said balancing cylinder.

DESCRIPTION OF THE PREFERRED EMBODIMENT

Figure 1:
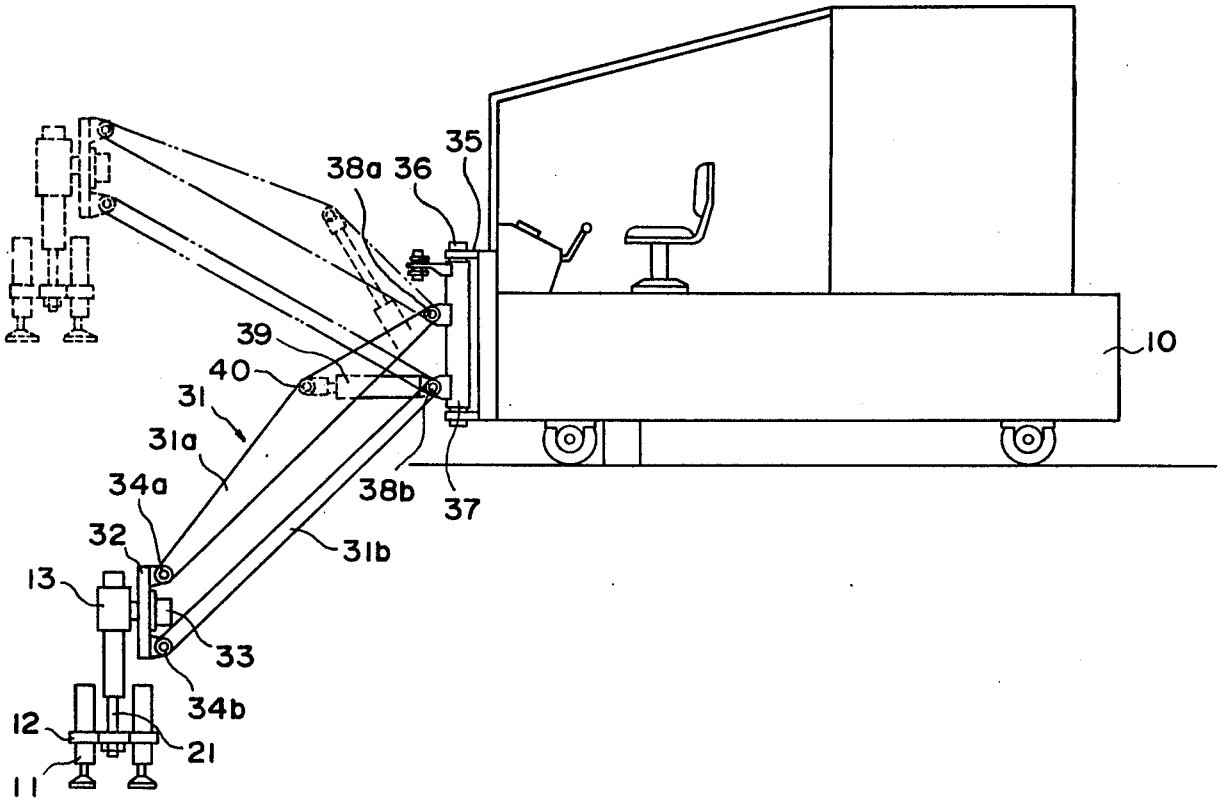
FIGS. 1 and 2 are respectively a side view and a plan view of a stamping apparatus according to an embodiment of the invention, which is mounted on a travelling device, e.g., a car.
Figure 2:
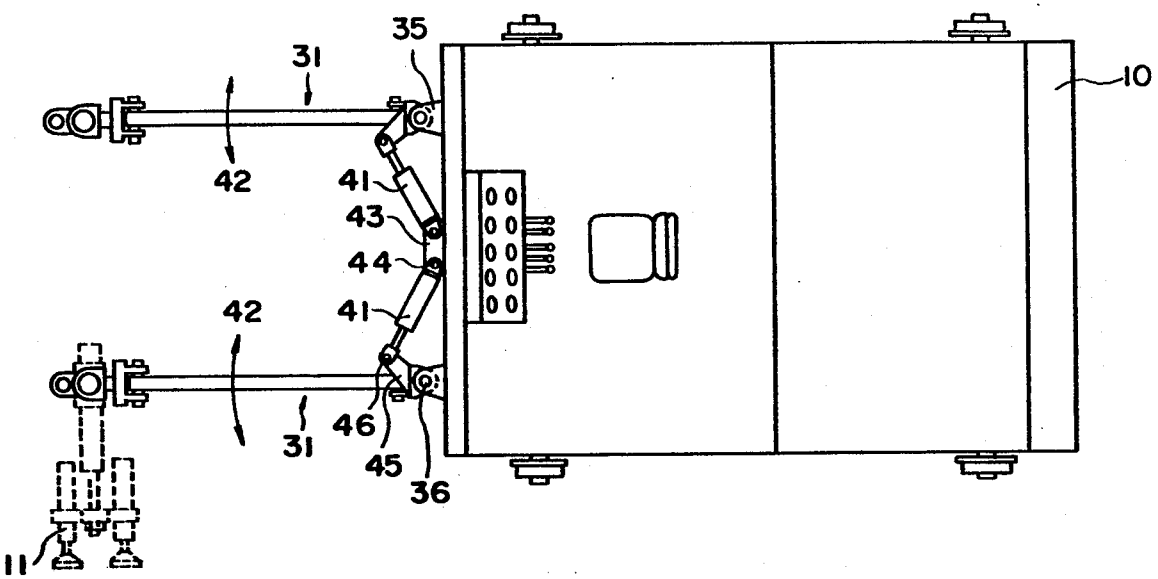

The stamping apparatus according to the invention will now be described in greater detail with reference to the illustrated embodiment. Referring to FIGS. 1 and 2, the apparatus is shown mounted on a travelling device or car 10 by way of example. The car 10 is equipped with an actuating unit for operating the car 10 and the stamping apparatus of this invention and it may include, if necessary, lining material storing and supply units. The car 10 is adapted to run on the rails by means of the wheels.

A vertical shaft 37 is vertically rotatably mounted by a pin 36 to a bracket 35 which is fixedly mounted on the car 10. An arm 31 consists of two bars **31*a* and 31*b* of the same length which are respectively pivoted, in vertically equally spaced relation, to the vertical shaft 37 and a metal base 32 by pins 38*a* and 34*a* and pins 38*b* and 34*b*, respectively. The base of an air cylinder 39 is pivotally mounted at the pin 38*b* of the vertical shaft 37 and the forward end of its piston rod is pivoted by a pin 40 to the central portion of the bar 31*a***.

As will be seen from FIG. 2, the base of another air cylinder 41 is pivoted by a pin 44 to a bracket 43 mounted to the central front portion of the car 10 and the forward end of its piston rod is pivoted by the pin 46 to a bracket 45 projected from the vertical shaft 37.

The bars **31*a* and 31*b*, the vertical shaft 37 and the metal base 32 constitute a link mechanism, so that by actuating the air cylinder 40 so as to extend and contract its piston, the bars 31*a* and 31*b*, the vertical shaft 37 and the metal base 32 are moved as shown by the dotted lines in FIG. 1 while maintaining their parallelism (the vertical shaft 37 alone is not moved) and the metal base 32 is vertically moved in its vertical position. On the other hand, since the vertical shaft 37 is rotatably mounted, when the air cylinder 41 is actuated so as to extend and contract its piston, the arm 31 is swivelled about the vertical shaft 37 as shown by an arrow 42 in FIG. 2. Consequently, the metal base 32 is moved horizontally. In the illustrated embodiment, two units of the apparatus according to the invention are mounted in the symmetrical positions on the front part of the car 10 as will be seen from FIG. 2**.

A balancing cylinder 13 is vertically supported on the metal base 32 by means of a turning gear 33.

Figure 3:
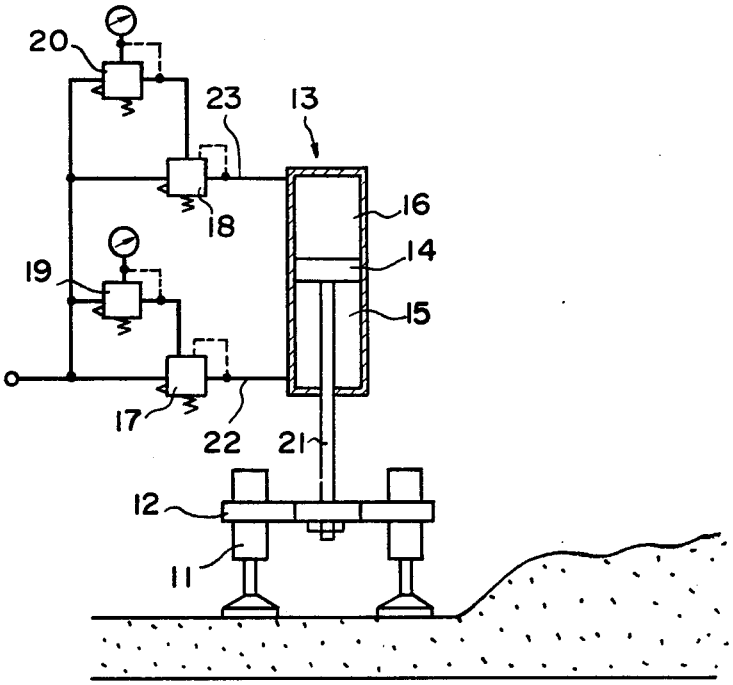
FIG. 3 is a schematic view showing the balancing cylinder used in the apparatus of this invention.

As shown in FIG. 3, the balancing cylinder 13 holds a piston 14 by its upper and lower cylinder chambers 16 and 15 and it has a pair of rammers 11 coupled to the forward end of a piston rod 21 by means of a metal mount 12. Provided respectively for the cylinder chambers 16 and 15 of the balancing cylinder 13 are compressed air inlet means inclusive of 23 and 22, setting regulators 20 and 19 and main control regulators 18 and 17.

Compressed air is introduced into the cylinder chambers 16 and 15 through the pipe lines 23 and 22, respectively, unitl their setting pressures are reached, and when the pressures in these chambers exceed the setting pressures, the compressed air is discharged by the main control regulators 19 and 17. The pressure of the upper cylinder chamber 16 is selected to correspond to the pressure required to apply a desired pressing force to the rammers 11 when the latter are placed on a layer of lining material plus a pressure which balances the pressure in the lower cylinder chamber 15. The pressure for balancing the upper and lower cylinder chambers 16 and 15 each other is one required for absorbing the vibrations of the rammers 11.

Firstly, in order to change (reduce) the pressure of the compressed air from the primary pressure to the desired setting pressure, the setting regulators 20 and 19 respectively feed a setting pressure signal to the main control regulators 18 and 17, respectively. In response to the operation of the main control regulators 18 and 17, the compressure air is fed through the pipe lines 23 and 22 into the upper and lower cylinder chambers 16 and 15 until the setting pressures are attained, and the piston 14 is balanced in a position where the rammers 11 apply the desired pressing force to the layer of the lining material. If the setting pressure of the setting regulator 20 is increased, the pressure in the upper cylinder chamber 16 is increased and the piston 14 is forced downward. When the setting pressure of the setting regulator 19 is increased, the pressure in the lower cylinder chamber 15 is increased and the piston 14 is forced upward.

With the rammers 11 in operation, when the rammers 11 are vibrated or receive an impact, the vibrations are transmitted through the metal mount 12 and the piston rod 21 to the piston 14 and the piston 14 is rapidly moved vertically. When the piston 14 is moved upward, the pressure in the upper cylinder chamber 16 becomes higher than the setting pressure, so that the main control regulator 18 comes into operation and the compressed air in the upper cylinder chamber 16 is instantaneously discharged to the atmosphere until the pressure is reduced to the setting pressure. On the other hand, the upward movement of the piston 14 causes the pressure in the lower cylinder chamber 15 to become lower than the setting pressure, so that the main control regulator 17 comes into operation and the compressed air is supplied into the lower cylinder chamber 15 until the pressure therein is increased to the setting pressure. On the contrary, when the piston 14 is moved downward, the pressure in the upper cylinder chamber 16 drops below the setting pressure, and consequently the compressed air is supplied into the upper cylinder chamber 15 by the action of the main control regulator 18 until the pressure in the upper cylinder chamber 16 is returned to the setting pressure. On the other hand, the pressure in the lower cylinder chamber 15 becomes higher than the setting pressure and consequently the compressed air in the lower cylinder chamber 15 is instantaneously discharged to the atmosphere by the action of the main control regulator 17.

In this way, the vibrations or impact produced by the rammers 11 can be absorbed and relieved by the operation of the balancing cylinder 13 thus maintaining the pressing force of the rammers 11 at a constant level. Where the number of vibrations of the rammers 11 is high in a given time period or the vertical displacement of the rammers 11 due to the vibrations is small, this can be met by the inherent compressibility of the compressed air in the upper and lower cylinder chambers 15 and 16.

Figure 4:
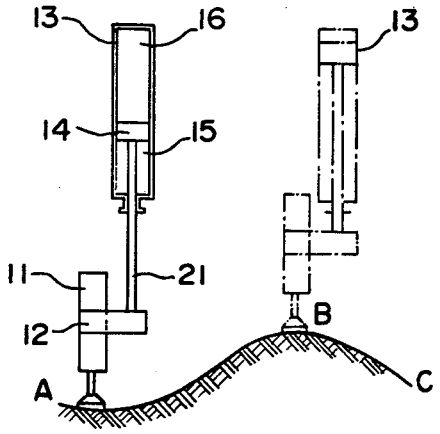
FIG. 4 is a view usefuel for explaining the operation of the rammers used in the apparatus of this invention.

The detailed operation of the rammers 11 and the balancing cylinder 13 will now be described with reference to FIG. 4.

When the rammers 11 are moved from a point A to a higher point B by following the working surface, the piston 14 is moved upward as shown by the dotted line, so that the pressure in the upper cylinder chamber 16 is increased over the setting pressure and consequently the compressed air in the upper cylinder chamber 16 is instantaneously discharged to the atmosphere by the action of the main control regulator 18 until the pressure in the upper cylinder chamber 16 reaches the setting pressure. On the other hand, the pressure in the lower cylinder chamber 15 is decreased below the setting pressure and consequently the compressed air is supplied into the lower cylinder chamber 15 by the action of the main control regulator 17 until the pressure in the lower cylinder chamber 15 reaches the setting pressure. Similarly, in FIG. 4, when the rammers 11 are moved from the point B to a lower position C by following the working surface, the piston 14 is moved downward, so that the pressure in the upper cylinder chamber 16 is decreased below the setting pressure and consequently the compressed air is supplied into the upper cylinder chamber 16 by the action of the main control regulator 18 until the pressure in the upper cylinder chamber 16 reaches the setting pressure. On the other hand, the pressure in the lower cylinder chamber 15 is increased over the setting pressure and consequently the compressed air in the lower cylinder chamber 16 is instantaneously discharged to the atmospher by the action of the main control regulator 17 until the pressure in the bottom cylinder chamber 15 reaches the setting pressure.

Next, the application of a lining material to an iron runner by the stamping apparatus of this invention will be described.

The application of a lining material will be started from the bottom portion of the runner. The process of applying a lining material by the apparatus of this invention may be accomplished by either of two methods, namely, in the first method, while supplying a lining material, the car 10 is moved slowly while causing the arm 31 to swivel and in this way the lining material is gradually stamped in the longitudinal direction by the rammers 11. In the second method, a lining material is first supplied to the entire runner and the car 10 is simply moved to stamp the material in the longthwise direction while gradually shifting the rammers 11 traversely so as to stamp the lining material throughout the entire width of the runner.

While the stamping efficiency may be increased by increasing the amount of lining material fed for each operation, if the lining material supplied is excessively thick, the compaction of the material on the lined surface will be deteriorated. In the case of the conventional mannually operated rammers, the maximum amount of lining material that can be supplied for each operation is limited to a range of 100 to 200 mm. With the apparatus of this invention, a lining material may be supplied to a thickness of 200 to 300 mm with the resulting improvement in efficiency.

After the lining material has been fed into the runner, the stamping operation is started after adjusting the pressures in the upper and lower cylinder chambers 16 and 15 of the balancing cylinder 13 in such a manner that the piston 14 of the balancing cylinder 13 is brought to a position approximately corresponding to the middle of the upward stroke of the piston 14 when the arm 31 is moved thus causing the rammers 11 to come with a suitable pressing force into contact with the working surface at the intermmediate position of the undulations of the lining material.

When it is desired to apply a lining material to the side surface of the iron runner, the turning gear 33 is operated so as to turn the balancing cylinder 13 and the rammers 11 sideways as shown by the dotted lines in FIG. 2. Then, by actuating the cylinder 39 to cause the arm 31 to rise and fall, it is possible to move the rammers 11 over the entire area of the side surface from the top to the bottom and thereby to stamp the lining material in the similar manner as the bottom surface. While there are many cases where the lining of the side surface of an iron runner is effected in the inclined working surface, the lining in such a case may be similarly effected by first turning the balancing cylinder 13 and the rammers 11 by the turning gear 33 to cause the rammers 11 to vertically contact with the working surface and then effecting the stamping in the similar manner. Although the plane of movement of the balancing cylinder 13 due to the movement of the arm 31 is not in parallel with the working surface, the rammers 11 can be caused to follow the working surface through the action of the balancing cylinder 13.

With the construction described above, the stamping apparatus of this invention is capable of moving the rammers 11 either horizontally or vertically as desired by swivelling or vertically moving the arm 31 and thereby easily stamping a lining material on the bottom and side surfaces of iron runners. As a result, the stamping of a lining material which has heretofore been effected by means of manually operated rammers, can now be entirely carried out mechanically, thus ensuring saving of hands and reduction of the lining time as well as uniform lined surfaces.

Moreover, by virtue of the fact that the abovedescribed rammers 11 for stamping lining material are operated by the balancing cylinder 13 provided with regulators which automatically regulate the compressed air in the balancing cylinder 13, the rammers can be rapidly and smoothly adjusted automatically to conform with the ups and downs in the lining working surface of an iron runner and thereby to stamp the lining material with the same pressure, thus ensuring uniform finish on the lined surface and improved quality for the finished lining material.

Further, by virtue of the fact that the stamping apparatus of this invention is used by mounting it on the car 10, the car 10 may be moved along an iron runner to continuously effect the lining of the entire iron runner. Still further, while the stamping apparatus of this invention can be mounted and operated by an operator on a travelling device such as a car, the control handles may be connected externally by cables so as to permit remote control as well automatic control of the apparatus.

What is claimed is:

1. A stamping apparatus for applying a lining material to an iron runner comprising:

arm means mounted at the base thereof to a travelling device and including a base member vertically mounted to one end thereof, said arm means further including a link mechanism and a swivelling mechanism, whereby said arm means is adapted to vertically and horizontally move said base member;

a balancing cylinder vertically supported on said base member through the intermediary of turnning means, said balancing cylinder holding therein a piston by upper and lower cylinder chambers, said balancing cylinder including compressed air inlet means, setting regulator means and main control regulator means for maintaining the pressure in each of said cylinder chambers at a setting pressure and a piston rod whereby maintaining constant the pressing force of at least one rammer mounted to one end of said piston rod, said balancing cylinder being rotatable so as to be held horizontally as well as in an inclined position; and said at least one rammer mounted to said piston rod in parallel with said balancing cylinder.

2. A stamping apparatus according to claim 1, wherein said arm means comprises a pair of bars of the equal length which are pivoted at one ends thereof to a vertical shaft mounted to said travelling device and at other ends thereof to said base member in a vertically equally spaced relation with each other, wherein an air cylinder is pivoted at the base thereof to said vertical shaft, said air cylinder including a piston rod pivoted at one end thereof to the central portion of one or the other of said pair of bars, and wherein another air cylinder is pivoted at the base thereof to said travelling device, said another air cylinder including a piston rod pivoted at one end thereof to a bracket projected from said vertical shaft, whereby said two air cylinders produce vertical and horizontal swivelling motions of said arm means.

3. A stamping apparatus according to claim 1 wherein said travelling device is a car.

4. A stamping apparatus according to claim 2, wherein said travelling device is a car.

* * * * *